United States Patent [19]

Brass

[11] Patent Number: 4,729,075

[45] Date of Patent: Mar. 1, 1988

[54] CONSTANT ZONE REFLECTOR FOR LUMINAIRES AND METHOD

[76] Inventor: John R. Brass, 566 Woodbine Dr., San Rafael, Calif. 94903

[21] Appl. No.: 738,869

[22] Filed: May 29, 1985

[51] Int. Cl.[4] ..... F21S 3/00

[52] U.S. Cl. ..... 362/217; 362/290; 362/342; 362/346; 362/223

[58] Field of Search ..... 362/217, 223, 33, 296, 362/297, 299, 301, 307, 308, 260, 290, 341, 342, 346, 336, 339

[56] References Cited

U.S. PATENT DOCUMENTS

| | | | |
|---|---|---|---|
| 1,878,632 | 9/1932 | Hacheney | 362/235 |
| 2,242,872 | 5/1941 | Rolph | 362/330 |
| 2,565,435 | 8/1951 | Leinen | 362/217 |
| 2,591,661 | 4/1952 | McCandless | 362/217 |
| 3,015,721 | 1/1962 | Guth | 362/217 |
| 3,123,308 | 3/1964 | Franck | 240/25 |
| 3,700,877 | 10/1972 | Wilson | 240/3 |
| 4,028,542 | 6/1977 | McReynolds | 240/41.36 |
| 4,053,766 | 10/1977 | Brass | 362/301 |
| 4,081,667 | 3/1978 | Lewin et al. | 362/296 |
| 4,277,820 | 7/1981 | Bostonian | 362/223 |
| 4,336,576 | 6/1982 | Crabtree | 362/240 |
| 4,344,111 | 8/1982 | Ruud et al. | 362/247 |
| 4,422,134 | 12/1983 | Brass | 362/301 |
| 4,439,816 | 5/1984 | Litchfield | 362/96 |
| 4,621,309 | 11/1986 | Grawe et al. | 362/342 |

FOREIGN PATENT DOCUMENTS

| | | | |
|---|---|---|---|
| 545358 | 5/1942 | United Kingdom | 362/223 |
| 0252035 | 12/1985 | Japan | 362/290 |

OTHER PUBLICATIONS

A.P.C. Application of Salani, 433386, Published 5/1943.

*Primary Examiner*—William A. Cuchlinski, Jr.
*Assistant Examiner*—D. M. Cox
*Attorney, Agent, or Firm*—Phillips, Moore, Lempio & Finley

[57] ABSTRACT

A luminaire of the direct lighting type includes a fluorescent lamp for emitting a torodial light pattern to a reflector assembly having a plurality of flat and contiguous facets spaced laterally from the lamp. The reflector functions to reflect the torodial light pattern within parallel light distribution zones. The reflector may be of the cross-beam type (FIGS. 1-4) or down-beam type (FIG. 5). The facets are precisely positioned relative to the light source to provide the above functions whereby the luminaire will function efficiently and will closely control direct and reflected glare. A louver-lens assembly can be utilized to enclose the open bottom of the luminaire and to aid in these functions, a method is also taught for plotting the precise positions of the facets.

30 Claims, 5 Drawing Figures

FIGURE 2
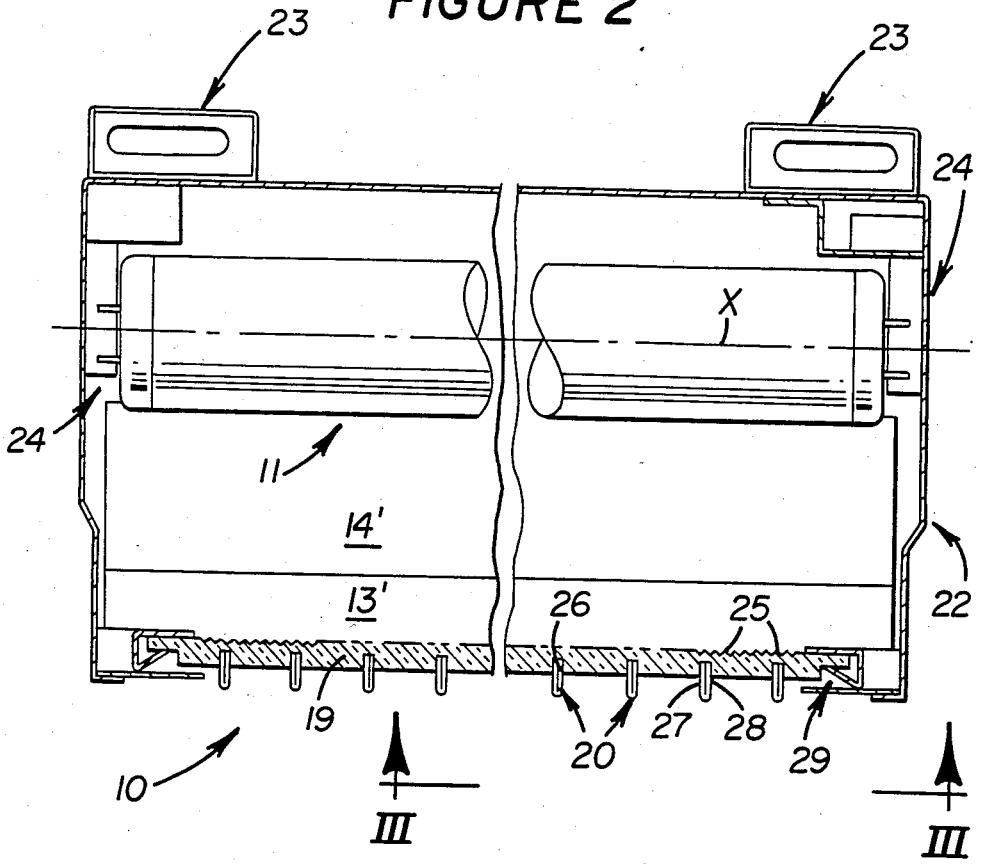
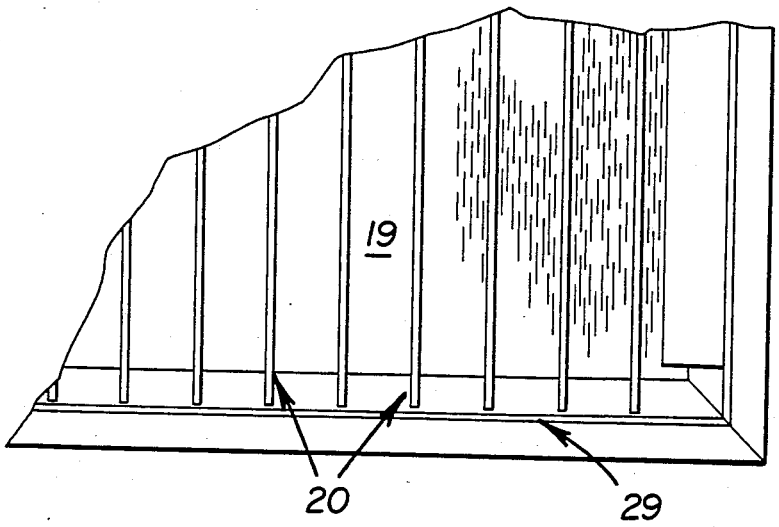
FIGURE 3

CONSTANT ZONE REFLECTOR FOR LUMINAIRES AND METHOD

DESCRIPTION

1. Technical Field

This invention relates generally to a luminaire of the direct lighting type and more particularly to a luminaire having reflector elements for reflecting light within parallel light distribution zones.

2. Background Art

Dramatic increases in energy costs have established the need for a highly efficient fluorescent luminaire that will provide a uniform light pattern on a visual task field at minimal cost. It has been common practice to reduce energy consumption by either reducing the number of luminaires utilized or by removing one or more fluorescent lamps from a standard luminaire. However, this approach has oftentimes resulted in illumination levels below that required for good visibility within the task field.

Recent studies have recognized that any further reduction in energy consumption must involve design improvements to increase the efficiency of the luminaire. Further, it has been concluded that a relatively high initial cost for a well-designed high performance luminaire could prove cost effective for achieving a specified level of illumination. Such cost effectiveness, i.e., a reduction in long term energy and maintenance costs, for a given level of illumination would result from the use of fewer luminaires for a particular job task, fewer light bulbs (lamps) in each luminaire, and/or lower wattage lamps in the luminaires.

Maintenance costs can be reduced, of course, when fewer luminaires and lamps are required. The advent of high quality reflector and lens materials, adapted to maintain their initial light transmitting and reflecting characteristics over a long period of time, provide for a higher luminaire lumen maintenance factor. In addition to higher luminaire efficiency, such a factor also allows a system designer to specify fewer luminaires than might otherwise be required to maintain a specified level of illumination. The above design approach generally runs contrary to conventional fluorescent luminaire design criteria, normally dictating that the initial cost of a luminaire must be reduced to its lowest possible level to stimulate the sale thereof. Low efficiency luminaires also lead to an increase in the number of lamps sold.

The conventional fluorescent parabolic louver luminaire is the present standard in the industry for exhibiting the highest level of efficiency and control of direct glare. However, the cost of a parabolic louver luminaire is approximately twice that of the conventional and slightly less efficient "white box" type of luminaire, commonly used in offices and the like. The latter luminaire is enclosed by a flat plastic lens mounted on the lower side thereof whereas the parabolic is not.

Although exhibiting a relatively low brightness and direct glare when observed from a distance, the standard fluorescent parabolic louver luminaire exhibits several deficiencies, in addition to relatively high cost, including: a relatively narrow light distribution pattern; an excessive reflected glare rating resulting from straight-down candlepower being relatively high (ideally, no light should be directed straight downwardly or within 30° of nadir, i.e., an imaginary vertical line below the center of the luminaire); and the appearance of bare lamp images on glossy reading materials, due to the absence of a lens on the lower side of the luminaire.

In addition, there is no practical way to easily clean the cells of the conventional parabolic louver luminaire. Further, the exposed lamps and reflectors thereof are conductive to the collection of dirt particles thereon in contrast to luminaires of the fully enclosed type. Also, conventional luminaires of this type exhibit a 7% to 15% light loss due to the width of the top of each louver thereof, and the smooth-curve "parabolic" louvers employed therein must use relatively inefficient semi-specular aluminum reflectors due to the unforgiving nature of the specular material used, i.e., each louver must be near perfect in shape to prevent the occurrence of "hot spots" in the task field light pattern. Still further, the standard white-painted upper portion of the luminaire produces a significant amount of light diffusion loss, similar to that lost in the "white box" type of luminaire.

Applicant is further unaware of the utilization of a structurally integrated louver and lens to enclose the open bottom of a commercial luminaire.

DISCLOSURE OF INVENTION

An object of this invention is to provide a highly efficient and energy-saving luminaire that exhibits exceptional control of direct and reflected glare, a high degree of durability and that is conducive to easy maintenance. As discussed more fully hereinafter, a commercial luminaire embodying this invention will function to allow a very high percentage of concentrated lamp output to be delivered uniformly onto a visual task field while yet minimizing straight down candle power, when the luminaire is ceiling mounted.

In its broadest aspect, the luminaire of this invention comprises light source means, such as a fluorescent lamp bulb, for emitting a torodial light pattern and reflector means for receiving and reflecting the torodial light pattern within parallel light distribution zones defined by equal cutoff angles. The ultimate effect is to create a uniform light pattern on a visual task field while simultaneously providing sharp cutoff of high angle direct glare and luminaire brightness when the luminaire is ceiling mounted and is observed from all normal viewing directions thereunder.

In another aspect of this invention, a structurally integrated louver-lens assembly is provided.

In still another aspect of this invention, a method is taught for carefully plotting the facets of the reflector means.

DEFINITION OF TERMS

The following definitions apply herein:

"Facet"—a planar reflector element or mirror strip.

"Cutoff angle"—The included acute angle between (1) a vertical plane intersecting a horizontally disposed longitudinal axis of a lamp, adapted to emit a torodial light pattern, and (2) one of the two rays of light that are tangential to opposite sides of the lamp image in a given facet of a reflector assembly and which cross before intersecting the two extremities of the facet.

Example: In FIG. 4, angle "$\alpha$" constitutes an "upper cutoff angle" between (1) plane Y (and its parallel plane Y') and (2) each light ray A' through E' whereas angle "$\beta$" constitutes a "lower cutoff angle" between (1) plane Y (and its parallel plane Y'') and (2) each light ray A through E.

"Light distribution zone"—The included angle between a selected pair of intersecting light rays (the pair of upper and lower cutoff angles for a given image).

Example: In FIG. 4, angles "a" through "e" each constitute a light distribution zone. The zones are deemed herein to be "parallel" and "constant" relative to each other. Hence the use of the term "constant zone reflector" to generally define the basic inventive concept of this invention.

"Zone direction ray"—The imaginary line bisecting a light distribution zone.

"Cross-beam reflector"—A reflector wherein the zone direction rays are disposed at an acute angle relative to a vertical plane intersecting the horizontally disposed longitudinal axis of a lamp (e.g., FIG. 4).

"Down-beam reflector"—A reflector wherein the zone direction rays are parallel relative to a vertical plane intersecting the horizontally disposed longitudinal axis of a lamp (e.g., FIG. 5).

BRIEF DESCRIPTION OF THE DRAWINGS

Other objects and advantages of this invention will become apparent from the following description and accompanying drawings wherein:

FIG. 2 is a partial longitudinal sectional view through the luminaire, generally taken in the direction of arrows II—II in FIG. 1;

FIG. 3 is a partial bottom plan view of the luminaire, taken in the direction of arrow III—III in FIG. 2;

BEST MODE OF CARRYING OUT THE INVENTION

GENERAL DESCRIPTION

Figure 1:
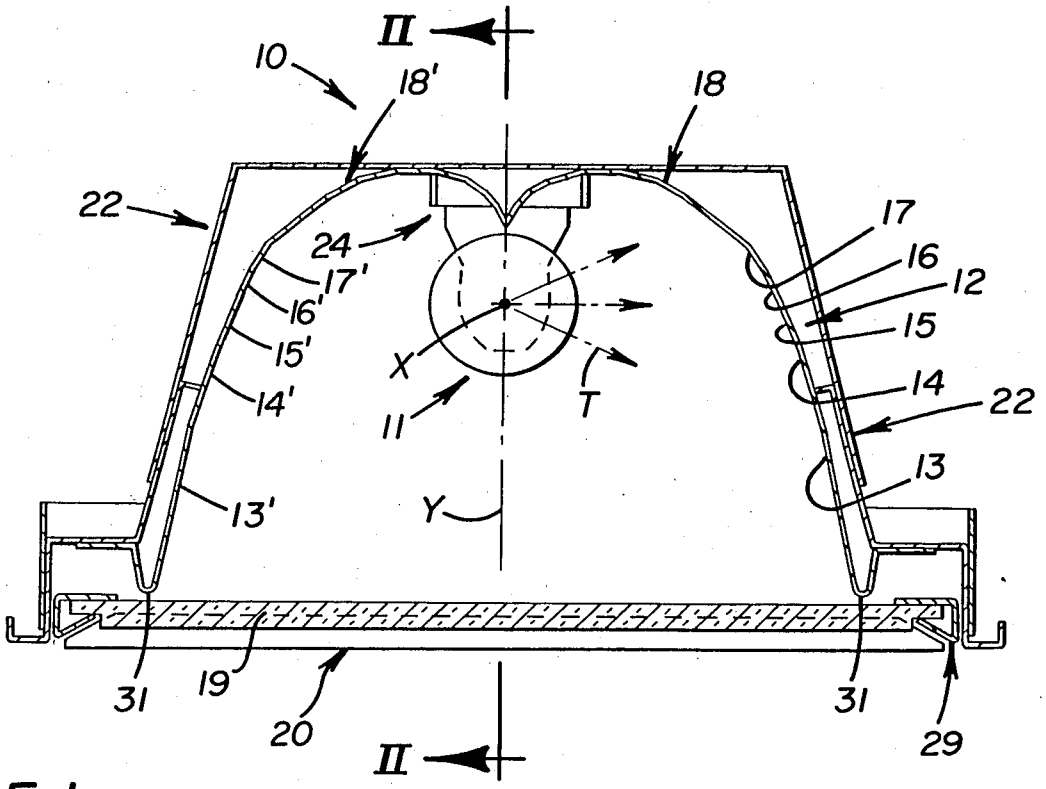
FIG. 1 is a cross-sectional view through a luminaire of the cross-beam type, embodying the present invention.

FIGS. 1-3 illustrates a commercial luminaire 10 of the direct lighting and cross-beam type (see above definition of "cross-beam reflector"), particularly adapted for recess mounting on a ceiling. The luminaire extends in the direction of a longitudinal axis X thereof. Commercial luminaires of this type may consist of one or more reflector assemblies and associated hardware, arranged in side-by-side relationship relative to each other in the well-known manner. In addition to recess mounting, the luminaire could be surface, pendant or bracket mounted while yet still embodying the hereinafter described design principles of this invention therein.

Figure 4:
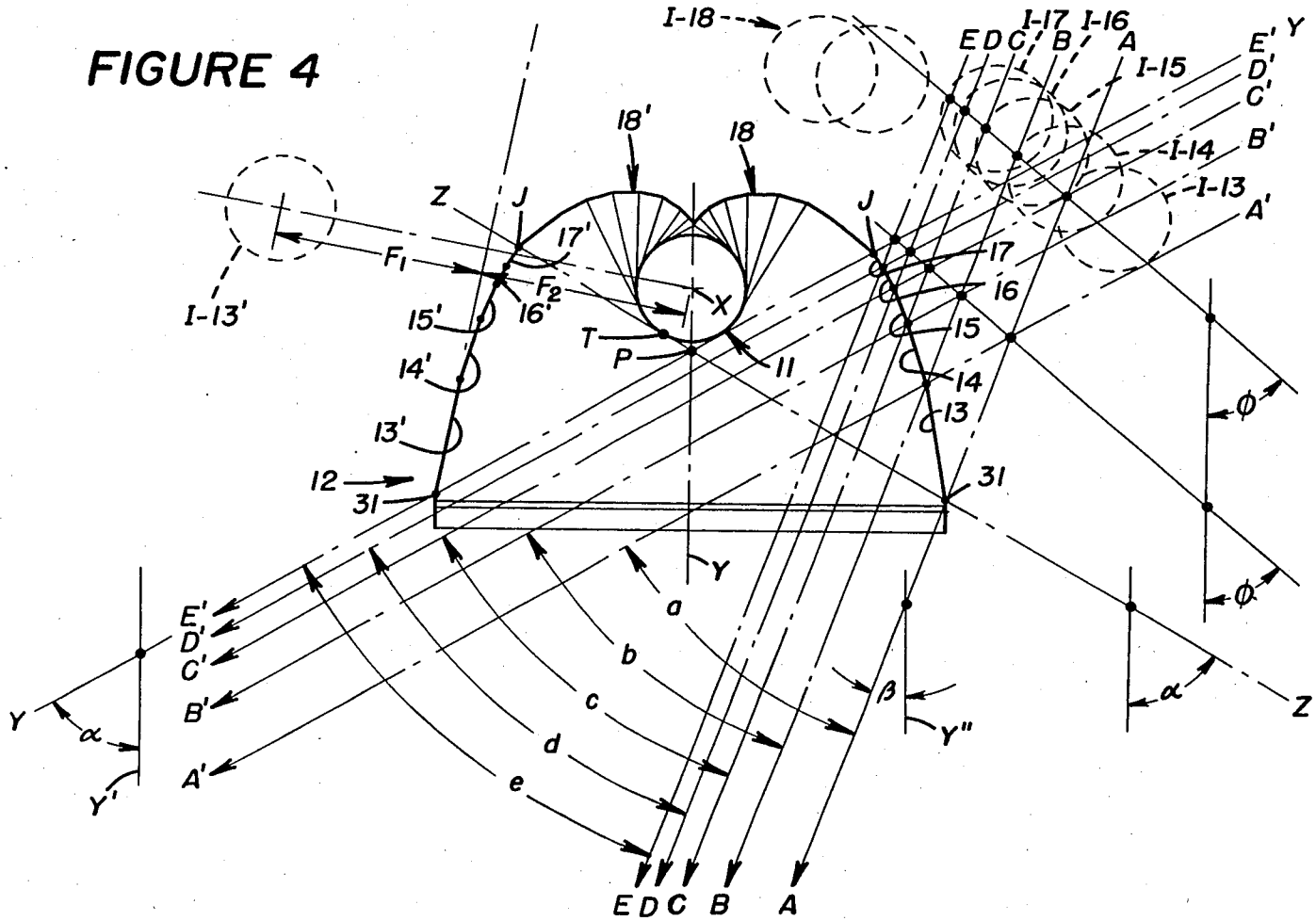
FIG. 4 is a cross-sectional view, generally similar to FIG. 1, schematically illustrating basic design principles embodied in the luminaire.

Luminaire 10 is adapted to be mounted on the ceiling of an office or the like for emitting a uniform light pattern onto a visual task field therebelow. The luminaire comprises a linear light source 11, preferably a standard fluorescent lamp bulb, for emitting a torodial light pattern T radially outwardly generally from the center and longitudinal axis of the lamp, shown for illustration purposes as being co-incident with longitudinal axis X. The luminaire further comprises a constant image zone reflector assembly 12, disposed parallel to axis X, that includes contiguous facets 13-17 and additional facets 18 for reflecting light pattern T from lamp 11 into smooth and sharp cutoff reflected light rays, transversely relative to axis X. (FIG. 4.)

As discussed more fully hereinafter with particular reference to FIG. 4, light rays A'-E' and A-E are reflected from facets 13-17 to define cutoff angles $\alpha$ and $\beta$, respectively. The rays further define parallel light distribution zones "a" through "e" and light beams therein. Again referring to FIG. 1, the luminaire further includes a lens 19 and a plurality of structurally integrated parallel louvers 20 which combine with the lens to provide means for transmitting, refracting and reflecting light rays A-E and A'-E' only in a direction parallel to axis X. This arrangement provides for the sharp cutoff of high angle direct glare and luminaire brightness when the luminaire is viewed from below, parallel to longitudinal axis X of the luminaire and lamp 11.

As discussed above, a common problem encountered with the use of luminaires of this general type, i.e., the standard fluorescent parabolic louver luminaire, is that an inordinately high number of luminaires and/or lamps are required to provide a specified level of illumination on a visual task field. As further discussed above, the present trend towards energy conservation has established the need for applicant's improved and highly efficient luminaire that, by tests, has proven to achieve such level of illumination by utilizing a significantly smaller number of luminaires and/or lamps than would otherwise be required by use of conventional luminaires. In addition to its energy-saving characteristics, applicant's luminaire provides exceptional control of direct and reflected glare, exhibits a high degree of durability and is adapted to be easily maintained.

DETAILED DESCRIPTION (FIGS. 1-3)

Referring to FIGS. 1 and 2, luminaire 10 is adapted to be recessed in a ceiling in a conventional manner. Suitably formed plates and panels 22 and internally secured reflector assembly 12 are structurally integrated to form an enclosure for light source 11, along with removable louver-lens assembly 19, 20. A pair of longitudinally spaced wiring conduits 23 are suitably secured to the plates to provide wiring connections for fluorescent lamp bulb 11 which is mounted in standard lamp holders 24, as illustrated in FIG. 2. As shown in FIG. 1, image zone reflector assembly 12 preferably forms an inverted general M-shaped configuration, when viewed in cross-section, and includes a first set of contiguous and interconnected planar reflector elements (mirror strips) or facets 13-18.

The facets extend longitudinally throughout the full length of the assembly in parallel relationship relative to longitudinal axis X. An additional and identical second set of facets 13'—18' are preferably formed on the opposite, lateral side of the image zone reflector assembly with the two sets of facets being symmetrical relative to a vertically and centrally disposed plane P, intersecting axis X. Since second set of facets 13'-18' are identical in construction and function to first set of facets 13-18, only the design, construction and reflecting functions of the first set of facets will be discussed in detail hereinafter.

Still referring to FIGS. 1 and 2, each facet 13-18 is prefinished to provide an exposed specular (mirror-like) finish. The particular high quality reflector material and reflecting surface chosen preferably exhibits a specular reflectance factor exceeding 0.84. For example, a finely polished aluminum reflector sheet (anodized) will exhibit a specular reflectance factor within the range of from approximately 0.84 to 0.86. The finest plastic film silver reflector material (laminated to a sheet aluminum substrate) will exhibit a specular reflectance factor within the approximate range of from 0.94 to 0.97. For example, 3M manufactures a front-silvered plastic film of this type under its trademark "Silverlux."

Facets 13–18, cooperating with light distributing lens 19 and glare controlling louvers 20, will deliver a very high percentage of lamp output uniformly onto a visual task field below the luminaire while minimizing straight down candle power and concentrating light output between approximately 30° and 60° cones of light below the luminaire. For example, and briefly referring to FIG. 4, angles $\alpha$ and $\beta$ depict typical upper and lower sharp cutoff angles of an image 1-13 (glare) created by reflector 13 whereby the visual task field will be uniformally illuminated. It should be noted in FIG. 1 that the lowermost edge of reflector 13 is positioned closely adjacent to lens 19.

As more fully described hereinafter with reference to FIG. 4, lowermost first facet 13 of facets 13–17 is disposed at a first acute angle relative to plane P. First image 1-13, created by first facet 13, is defined by a pair of first and second light rays A—A and A'—A' intersecting on a backside of the first facet. The rays are tangential to opposite sides of the first image and intersect with upper and lower extremities of the first facet. The center of the first image is positioned on the backside of the facets at a distance (e.g., $F_1$ for image 1-13' of corresponding image 13') from an extended flat plane containing the first facet that is equal to the distance (e.g., $F_2$) from the flat plane to axis X of light source means 11. First and second rays A,A' define the boundaries of a first light distribution zone "a" and further define first and second cutoff angles $\alpha$ and $\beta$, respectively, relative to their intersection with vertical plane P.

Still referring to FIG. 4, second facet 13 of facets 13–17 is disposed at a second acute angle relative to plane P and has its lower extremity connected to the upper extremity of first facet 13. A second image 1-14 is created by the second facet and is defined by a pair of third and fourth light rays B,B' intersecting on a backside of second facet 14. The rays are tangential to opposite sides of second image I-14 and further intersect lower and upper extremities of the second facet. The center of second image I-14 is positioned on the backside of the facets at a distance from an imaginary extended second flat plane containing second facet 14 that is equal to the distance from such plane to axis X of light source means 11, in a similar to that described above with reference to image I-13. It should be noted in FIG. 4 that the first acute angle defined between first facet 13 and plane P is less than the second acute angle for facet 14, et sequence.

Second and third rays B, B' define the boundaries of a second light distribution zone "b" and further define cutoff angles $\alpha$ and $\beta$ equal to the above-described first and second cutoff angles, respectively, associated with zone "a". The first and second light distribution zones are parallel and constant relative to each other. Thus, the expression "constant zone reflector" to define this aspect of the invention. Further in FIG. 4, first and second zone direction rays (not shown) bisecting first and second light distribution zones "a" and "b", respectively, are disposed in parallel relationship relative to each other and are each further disposed at an actue angle relative to vertical plane P whereby the luminaire is considered to be of the "cross-beam type," as defined above.

Also in FIG. 4, first cutoff angle $\alpha$ constitutes an "upper cutoff angle," defined by first ray A' being tangential with a lower side of first image I-13, and second cutoff angle $\beta$ constitutes lower cutoff angle $\beta$, defined by second ray A being tangential with an upper side of the first image. Upper cutoff angle $\alpha$ preferably approximates 60° and lower cutoff angle $\beta$ is preferably selected from the range approximating from 20° to 30°.

As more fully described hereinafter with reference to the second disclosed embodiment shown in FIG. 5, first and second zone direction rays (not shown), bisecting corresponding first and second light distribution zones "a" and "b", respectively, are disposed in parallel relationship relative to each other. Further, the rays are each parallel relative to vertical plane P whereby this luminaire is considered to be of the "down-beam type." as also defined above. It should be further noted in FIG. 5 that first and second cutoff angles $\alpha$ and $\beta$ are at least substantially equal. Each of the cutoff angles is preferably selected from the approximate range of from 20° to 60° and still more preferably, each approximately 30°.

Referring to FIGS. 2 and 3, louver-lens assembly 19, 20 fully covers and encloses the open bottom of the reflector assembly. The lens is preferably composed of an extruded or molded clear and colorless acrylic plastic material (e.g., Plexiglas) that will exhibit a long service life and maintain color stability. An inner (and/or outer) surface of the lens is formed with a multiplicity of light splitting and standard mini-prisms 25, disposed in parallel relationship relative to each other and transversely relative to axis X (FIGS. 1 and 2). The prisms can be formed on the selected surface or surfaces of the lens during extrusion or molding thereof in a conventional manner.

Each louver 20 is secured within a continuous groove 26, formed on an outer side of lens 19 to extend parallel relative to prisms 25. As further illustrated in FIGS. 2 and 3, each louver 20 preferably comprises a suitably configured sheet of specular aluminum reflector material that is folded-over onto itself to have its free ends embedded and anchored in a respective groove 26 of lens 19 and its closed end exposed on the outer side of the lens. Laterally disposed outer surfaces 27 and 28 of each louver are pre-polished to provide prefinished specular (mirror-like) reflecting surfaces preferably having a specular reflectance factor in the above-mentioned range of from 0.84 to 0.86 or higher.

The combined lens 19 and louver 20 subassembly may be suitably mounted in a rectangular frame 29, preferably hinge-mounted (not shown) on plates 22 of the luminaire in a conventional manner to facilitate servicing and cleaning. The frame is mounted on the luminaire, about the open bottom of reflector assembly 12. When a plurality of reflector assemblies are utilized in side-by-side relationship, frame 29 will be preferably constructed to surround the entire perimeter of the open bottoms of all of the reflector assemblies and lens 19 will preferably constitute a single lens in sheet form, mounted in the frame.

TECHNICAL DESCRIPTION AND METHOD FOR DESIGNING FACETS 13–18 OF REFLECTOR ASSEMBLY 12

Referring to FIG. 4, each set of facets 13–18 and 13'–18' is preferably designed in the following manner.

Although some of the design procedures and method steps hereinafter described may vary or be carried forth in a different sequence, the following procedure is the preferred one for designing the cross-beam type of reflector assembly 12 illustrated in Figures 1–4.

First, the designer determines the precise width of the open bottom of the reflector, between points 31 in FIG. 4. For example, this width could be determined to be 7" for a 24"×48" fluorescent luminaire using three 1½" diameter lamps 11, each mounted in a respective reflector assembly 12. The total width of the lens opening of the composite side-by-side three reflector assemblies is 21" to thus determine the 7" measurement between points 31 in FIG. 4.

Second, lines y—y and z—z are drawn at upper light cutoff angle $\alpha$ which is determined to be 60° for this particular embodiment of the invention. Upper cutoff angle $\alpha$ preferably closely approximates 60° for most commercial embodiments. This selected angle has been found to minimize direct glare to improve visual comfort prohability (VCP).

Third, the circumference of lamp 11 is centrally drawn tangent to the upper sides of lines y—y and z—z, above their intersection point p which is further intersected by plane Y.

Fourth, line A—A is drawn through point 31 at lower cutoff angle $\beta$ which is determined to be 20° is this embodiment of the invention. In each application of this invention, the particular lower cutoff angle $\beta$ chosen is intended to avoid reflected glare at a normal viewing angle approximating 25°, i.e., an angle between a person's line sight and a horizontal reading plane. Lower cutoff angle $\beta$ is preferably selected from the approximate range of from 20° to 30° for most commercial applications.

Fifth, a first lamp image I-13 is drawn tangent to a point along line A—A that is at a distance from point 31, on the right hand side of the reflector assembly in FIG. 4, equal to the distance along line z—z from such point 31 to the point of tangency T on lamp 11. Each image I-13 through I-18 (and their counterparts associated with facets 13' through 17') is plotted in the manner illustrated for plotting images I'-13' for facet 13'. In particular, the center of image I-13' is fixed at a distance $F_1$ that is equal to the distance $F_2$ between center X of lamp 11 and an imaginary line constituting a linear extension of facet 13'.

Sixth, line A'—A' is drawn at the upper cutoff angle $\alpha$ from a lower point of tangency on lamp image I-13.

Seventh, first facet 13 is drawn between lines A—A and A'—A' by using well known principles of physics (optics). Facet 13, when embodied in commercial reflector assembly 12 of FIG. 1, will thus function as a mirror strip creating lamp image I-13 (FIG. 4).

Angle $\alpha$, between lines A—A and A'—A', will establish a specific light distribution zone "a" between lower light cutoff angle $\beta$ and upper light cutoff angle $\alpha$ beyond which essentially no light is cast by facet 13. This unique construction and arrangement essentially resulted from applicant's discovery that the finite size of lamp image I-13 can be plotted and dealt with directly in establishing the light distribution zones. In contrast thereto, conventional ray tracing design techniques only deal with the optical center of a light source which leads to a smooth contour reflector design with no image zone determination. The essence of this invention is one of designing reflector facets that will provide well-defined and constant light distribution zones "a" through "e."

Applicable ones of the above seven steps are then essentially repcated to sequentially establish the width and angle of each additional facet 14–17. Also, facets 13'–17' are preferably symmetrically plotted in a like manner on the opposite side of the reflector assembly. Alternatively, second set of facets 13'–17' could be plotted asymmetrically relative to first set of facets 13–17. Other commercial embodiments of applicant's invention might include more or less facets in each set of facets.

The series of contiguous facets 18, between point "j"0 and plane Y at the center of the symmetrically formed facets, constitute a classical tangent spiral design that prevents light from being reflected back onto lamp 11 while yet directing such light onto image zone reflector elements or facets 13–17. A unique feature of spiral reflector elements 18 is that they consist of progressively smaller facets based on the illustrated imaginary lines tangent to lamp 11, disposed at 15° angles, for example. Other embodiments of this invention may not require tangent spiral reflector section 18.

Figure 5:
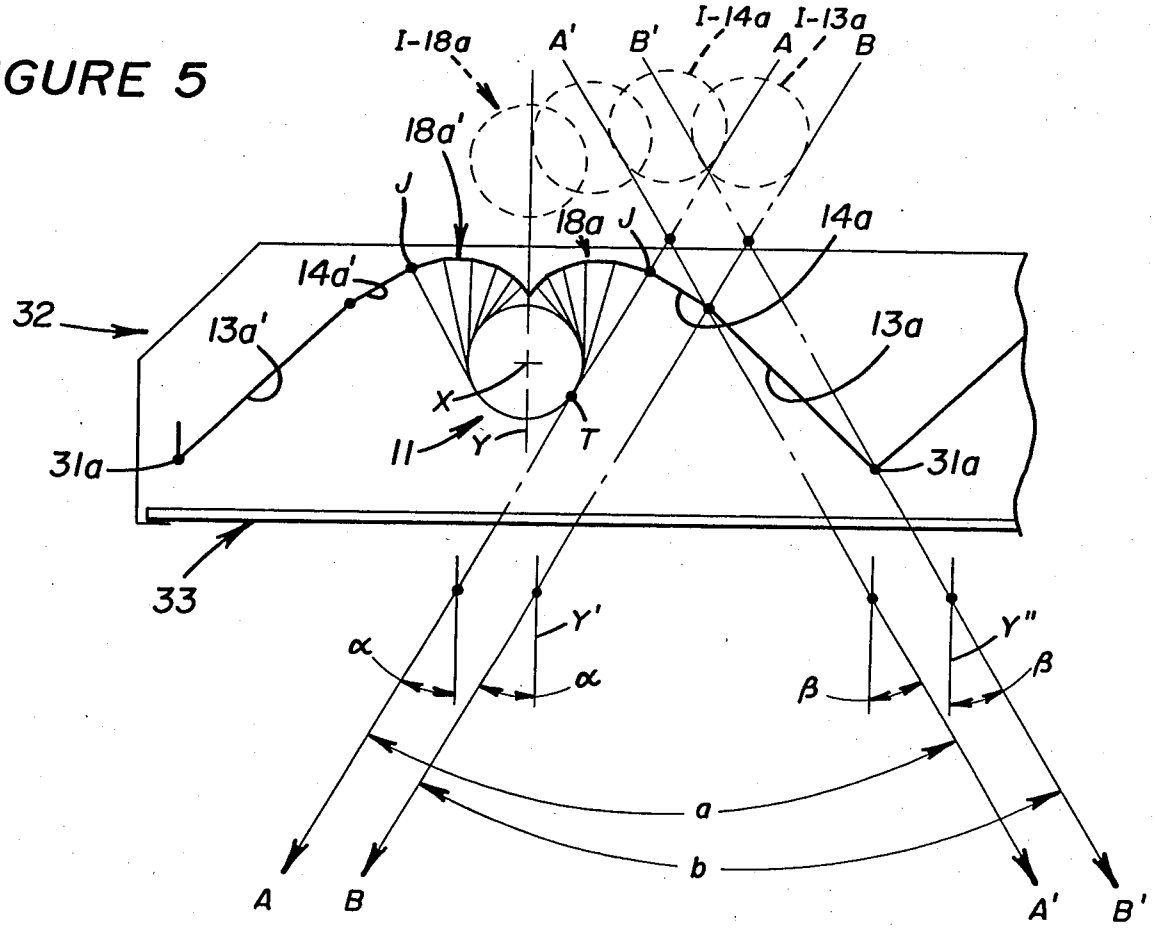
FIG. 5 is a view similar to FIG. 4, but illustrates a luminaire of the down-beam type which also embodies basic design principles of this invention.

FIG. 5 is a view similar to FIG. 4, but illustrates a luminaire of the down beam type (see above definition), also embodying basic design principles of this invention, e.g., constant and parallel light distribution zones corresponding to zones "a" through "e". It should be noted in FIG. 5 that light rays A, B and A', B' are schematically illustrated and their depiction, assumes absence of lens 33. In operation, the light rays would be deflected by the lens in the well-known manner. Basically, the reflector, assembly illustrated in FIG. 5, including facets **13*a* and 14*a* thereof, will result in light rays A, B and A', B' that reflect generally downwardly and do not cut across the full width of the reflector assembly, as it true with the corresponding light rays in the cross-beam reflector illustrated in FIG. 4. Testing has shown that the FIG. 5** reflector assembly greatly reduces direct glare, e.g., by approximately one-half.

The method for plotting the facets of the reflector assembly illustrated in FIG. 5 includes plotting the facets of the reflector assembly downwardly from point "j" to point 31A, rather than first determining the size of the bottom opening of the reflector assembly (from 31 to 31 in FIG. 4). Facets **18*a* are formed in the same manner as facets 18 were formed (FIG. 4). In FIG. 5, cutoff angles $\alpha$ and $\beta$ are equal angles on opposite sides of nadir (e.g., Y in FIG. 5). The constant zone reflector assembly of FIG. 5 is a unique type of semi-parabolic reflector that is particularly useful as a high performance retrofit unit for existing fluorescent luminaires of the shallow "white box" type, having a preinstalled housing 32 and a standard clear (transparent) prismatic lens 33** mounted thereon.

Cutoff angles $\alpha$ and $\beta$ are shown at 30° from nadir (plane Y and its parallel plane Y') which results in directing more light through lens 33 then would be reflected by the conventional "white box" interior reflector panels. The preferred range of angles for each angle $\alpha$ and $\beta$ is from approximately 20° to 60°. The standard "white box" interior would have multiple reflections (with losses at each reflection) whereas applicant's constant zone reflector facets **13*a* and 14*a* will each only allow a single reflection. Further, the constant zone reflector facets will direct no grazing angle light onto lens 33** whereby less light reflects from the top of the lens (Brewster effect).

I claim:

1. A luminaire of the direct lighting type for providing constant zone reflection of light comprising light source means, having a horizontally disposed longitudinal axis, for emitting a torodial light pattern, said light source means being bisected by an imaginary vertical plane intersecting said axis, and a reflector assembly including a plurality of reflector means mounted in spaced relationship from the axis of said light source means on at least one lateral side of said vertical plane and extending in parallel relationship relative to the axis of said light source means for receiving and reflecting said torodial light pattern within parallel light distribution zones, said reflector means comprising a plurality of contiguous facets each being flat and having a highly specular light reflecting surface at least generally facing said light source means, a lowermost first facet of said facets being disposed at a first acute angle relative to said plane, a first image created by said first facet being defined by a pair of first and second rays intersecting on a backside of said first facet and being tangential to opposite sides of said first image, said first and second rays further intersecting upper and lower extremities of said first facet and the center of said first image being positioned on the backside of said facets at a distance from an extended flat plane containing said first facet that is equal to the distance from said flat plane to the axis of said light source means.

2. The luminaire of claim 1 wherein said light source means comprises a fluorescent lamp bulb mounted in said luminaire.

3. The luminaire of claim 1 wherein a pair of said reflector assemblies are symmetrically disposed on opposite lateral sides of said vertical plane.

4. The luminaire of claim 1 wherein said light reflecting surface has a specular reflectance factor of at least 0.80.

5. The luminaire of claim 4 wherein said specular reflectance factor is at least 0.90.

6. The luminaire of claim 1 wherein said first and second rays define the boundaries of a first one of said light distribution zones and further define first and second cutoff angles, respectively, relative to their intersection with said vertical plane.

7. The luminaire of claim 6 wherein a second facet of said facets is disposed at a second acute angle relative to said plane and has its lower extremity connected to the upper extremity of said first facet, a second image created by said second facet being defined by a pair of third and fourth rays intersecting on a backside of said second facet and being tangential to opposite sides of said second image, said second and third rays further intersecting said lower extremity and an upper extremity of said second facet and the center of said second image being positioned on the backside of said facets at a distance from an extended second flat plane containing said second facet that is equal to the distance from said second flat plane to the axis of said light source means.

8. The luminaire of claim 7, wherein said first acute angle is less than said second acute angle.

9. The luminaire of claim 7 wherein said second and third rays define the boundaries of a second one of said light distribution zones and further define cutoff angles equal to said first and second cutoff angles, respectively, relative to their intersection with said vertical plane whereby said first and second light distribution zones are parallel and constant relative to each other.

10. The luminaire of claim 9 wherein first and second zone direction rays bisecting said first and second light distribution zones, respectively, are disposed in parallel relationship relative to each other and are each further disposed at an acute angle relative to said vertical plan whereby said luminaire is of the cross-beam type.

11. The luminaire of claim 10 wherein said first cutoff angle constitutes an upper cutoff angle defined by said first ray being tangential with a lower side of said first image and said second cutoff angle constitutes a lower cutoff angle defined by said second ray being tangential with an upper side of said first image.

12. The luminaire of claim 11 wherein said upper cutoff angle approximates 60° and said lower cutoff angle is selected from the range approximating from 20° to 30°.

13. The luminaire of claim 9 wherein first and second zone direction rays bisecting said first and second light distribution zones, respectively, are disposed in parallel relationship relative to each other and are each parallel relative to said vertical plane whereby said luminaire is of the down-beam type.

14. The luminaire of claim 13 wherein said first and second cutoff angles are at least substantially equal.

15. The luminaire of claim 14 wherein each of said first and second cutoff angles is selected from the approximate range of from 20° to 60°.

16. The luminaire of claim 15 wherein each of said first and second cutoff angles approximates 30°.

17. The luminaire of claim 9 wherein an additional series of planar facets are connected to an upper extremity of said first mentioned facets to extend towards said vertical plane and consist of progressively smaller facet means for preventing light from being reflected back onto said light source means while simultaneously directing such light onto said first-mentioned facets.

18. The luminaire of claim 1 further comprising a lens mounted on said luminaire to fully cover an open bottom of said reflector assembly.

19. The luminaire of claim 18 wherein said lens comprises a clear colorless plastic material having a plurality of prisms formed on at least one of the inner and outer surfaces thereof.

20. The luminaire of claim 19 wherein said prisms extend in parallel relationship relative to each other and transversely relative to said vertical plane.

21. The luminaire of claim 20 further comprising a plurality of parallel louvers secured to an outerside of said lens.

22. The luminaire of claim 21 wherein said louvers extend transversely relative to the longitudinal axis of said light source means.

23. The luminaire of claim 22 wherein each of said louvers comprises a piece of flat material folded over onto itself and having its free ends secured on an outer side of said lens and further having its opposite, folded end exposed outwardly from said lens, exposed lateral sides of each of said louvers having highly polished surfaces.

24. The luminaire of claim 18 further comprising a frame mounted on said luminaire about the perimeter of the open bottom of said reflector assembly and wherein said lens is mounted in said frame.

25. A luminaire comprising light source means disposed on a longitudinal axis thereof, a reflector assembly having said light source means mounted therein and further having an open bottom, and a combined and structurally integrated louver-lens means covering the open bottom of said reflector assembly for transmitting, refracting and reflecting light rays in directions parallel relative to said axis with sharp cut-off of high angle direct glare and luminaire brightness, said louver-lens means comprising a lens and a plurality of opaque louvers spaced one from another along said longitudinal axis and secured on an outerside of said lens in transverse relationship relative to said axis, said louvers having exposed reflecting surfaces exhibiting a specular reflectance factor of at least 0.84.

26. The luminaire of claim 25 wherein said lens is composed of a clear colorless plastic material having a plurality of prisms formed on at least one of the inner and outer surfaces thereof.

27. The luminaire of claim 26 wherein said prisms extend in parallel relationship relative to each other and transversely relative to said axis.

28. The luminaire of claim 25 wherein said louvers are parallel relative to each other.

29. The luminaire of claim 25 wherein each of said louvers comprises a piece of flat material folded over onto itself and having its free ends secured on the outer side of said lens and further having its opposite, folded end exposed outwardly from said lens, exposed lateral sides of each of said louvers having highly polished surfaces.

30. The luminaire of claim 25 further comprising a frame mounted on said luminaire about the perimeter of the open bottom of said reflector assembly and wherein said louver-lens means is mounted in said frame.

* * * * *